US006950529B2

(12) United States Patent
Wilmink

(10) Patent No.: US 6,950,529 B2
(45) Date of Patent: Sep. 27, 2005

(54) SYSTEM CONSISTING OF A MICROPHONE AND AN AMPLIFIER

(75) Inventor: Engbert Wilmink, Delft (NL)

(73) Assignee: Sonionmicrotronic Nederland B.V., Amsterdam (NL)

( * ) Notice: Subject to any disclaimer, the term of this patent is extended or adjusted under 35 U.S.C. 154(b) by 1055 days.

(21) Appl. No.: 09/860,010

(22) Filed: May 17, 2001

(65) Prior Publication Data

US 2001/0043705 A1 Nov. 22, 2001

(30) Foreign Application Priority Data

May 17, 2000 (NL) ..... 1015222

(51) Int. Cl.[7] ..... H04R 25/00
(52) U.S. Cl. ..... 381/174; 381/191; 381/113
(58) Field of Search ..... 381/92, 113, 116, 381/174, 191, 355, 360, 361; 367/170, 181, 173, 188; 29/594, 25.41, 25.42; 307/400

(56) References Cited

U.S. PATENT DOCUMENTS 5,255,246 A * 10/1993 van Halteren ..... 367/170
5,319,717 A * 6/1994 Holesha ..... 381/360
6,084,972 A * 7/2000 van Halteren et al. ..... 381/92

FOREIGN PATENT DOCUMENTS

| | | |
|---|---|---|
| EP | 0 533 284 A1 | 9/1992 |
| EP | 0 800 331 A2 | 10/1997 |
| EP | 0 802 700 A1 | 10/1997 |

* cited by examiner

*Primary Examiner*—Huyen Le
(74) *Attorney, Agent, or Firm*—Michaelson & Associates; Peter L. Michaelson

(57) ABSTRACT

Microphone/amplifier system in which the microphone comprises a case with an inlet opening, a diaphragm and a backplate, and the amplifier is arranged in the case and is coupled to the diaphragm/backplate system. In the case, the diaphragm forms a first partition between a first compartment containing the inlet opening to the surroundings and a second compartment accommodating the amplifier. According to the invention, the second compartment is divided by a second partition into a first and second subcompartment, while an opening of a predetermined volume is provided in the second partition, this volume having a magnitude such that air in the first subcompartment can be caused to vibrate only with sound vibrations of low frequencies. Through this feature, the frequency characteristic of the system can be influenced.

5 Claims, 3 Drawing Sheets

SYSTEM CONSISTING OF A MICROPHONE AND AN AMPLIFIER

The invention relates to a system consisting of a microphone and an amplifier, the microphone comprising a case with case walls, at least one opening to the surroundings being provided in at least one of the case walls, the microphone further comprising a system consisting of a diaphragm and a backplate, the amplifier being arranged in the case and being coupled to the system consisting of the diaphragm and the backplate, the diaphragm in the case forming a first partition between a first compartment in which the at least one opening to the surroundings terminates and a second compartment in which the amplifier is accommodated, the second compartment being essentially closed off from the surroundings.

Such a system is known, for instance, from EP-A-0800331 and is chiefly used for hearing aids. In such hearing aids, it is desirable that, for various applications, the frequency characteristic of the system can be given a particular form In the system known from EP-A-0800331, this is done by means of electronic filtering in the pre-amplifier. It is also known, however, that the configuration of the case can influence the frequency characteristic: a small opening in the diaphragm, for instance, provides for an effective suppression of the sensitivity to low frequencies.

The object of the present invention is to provide further possibilities of influencing the frequency response of a system of the above-mentioned kind with mechanical means.

To that end, the invention provides a system of the above-mentioned kind, characterized in that the second compartment is divided into a first and a second subcompartment by a second partition, an opening of a predetermined volume being provided in the second partition, the volume having a magnitude such that air in the first subcompartment can be caused to vibrate only with sound waves of low frequencies.

The second compartment, which is therefore not in communication with the surroundings via the so-called snout of the microphone, is usually referred to as the back volume of the microphone. By providing in this back volume a second partition having an opening therein, two subcompartments are created. While the subcompartment bounding the diaphragm is sensitive to all frequencies, that is, the air in that subcompartment vibrates with sound waves of all frequencies, the subcompartment located between the second partition and the case walls, and which therefore communicates with the second subcompartment via the opening in the second partition, is sensitive only to low frequencies, that is, the air in this subcompartment vibrates only with sound waves of low frequencies, The opening can therefore be seen as a mechanical equivalent of a self-inductance, which also has the property of attenuating high frequencies. The volume of the opening determines the location of the transitional frequency range between the low frequency range, in which the air in both subcompartments vibrates, and the high frequency range, in which only the air in the second subcompartment vibrates. Through an appropriate choice of the volume of the opening between the first and the second subcompartment, the sensitivity of the microphone to lower frequencies can be increased or reduced. This is based on the phenomenon that according as a back volume of a microphone is greater, the sensitivity of that microphone increases.

According to a first embodiment of the invention, the carrier of the amplifier, i.e. the printed circuit board with the amplifier, is at least partly arranged on at least a portion of the partition between the first and second subcompartment of the second compartment, while the opening may be provided both in the printed circuit board and in the mounting wall carrying the printed circuit board. Of course, the opening may also be provided exclusively in the second partition.

According to a second embodiment of the invention, the partition between the first and second subcompartment of the second compartment is formed by the carrier of the amplifier. In the printed circuit board, an opening of a suitable volume may then be provided.

Any feed-through openings through the second partition and/or printed circuit board for the purpose of wiring should be sealed in order that such openings do not influence the frequency characteristic.

In the following, the invention will be further elucidated on the basis of two exemplary embodiments, with reference to the drawings, in which.

The invention is of use in particular, but not exclusively, in a hearing aid, and will therefore be described in the following in the context of such an exemplary application.

Figure 1A:
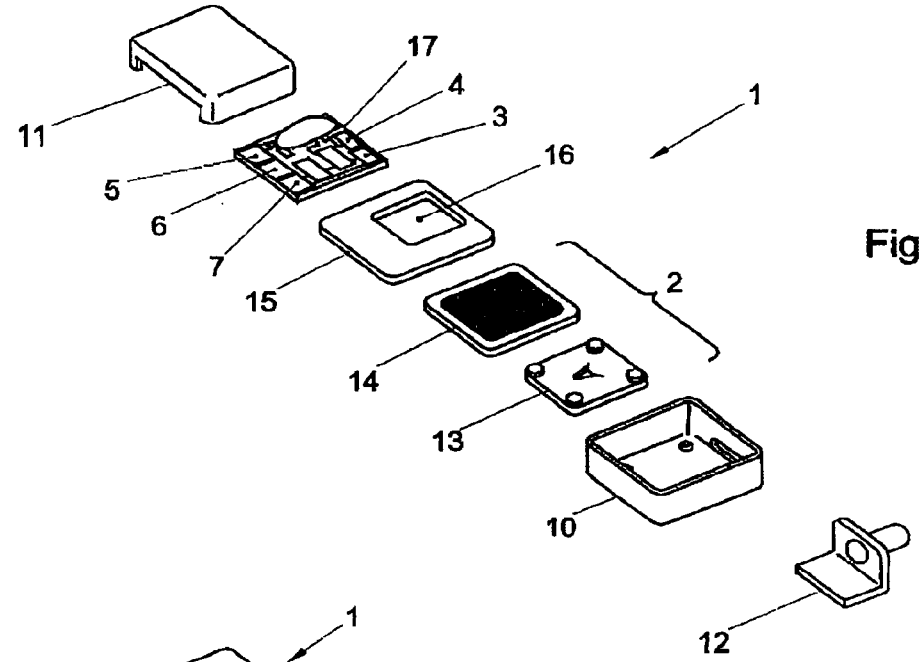
FIG. 1A is a schematic perspective view of the chief parts of a first embodiment of a microphone/amplifier system according to the invention, in disassembled condition.
Figure 1B:
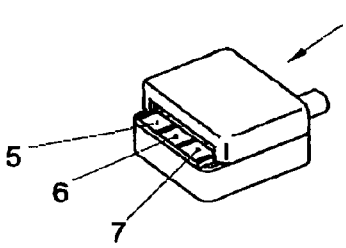
FIG. 1B is a schematic perspective view of the microphone/amplifier system of FIG. 1A in assembled condition.
Figure 1C:
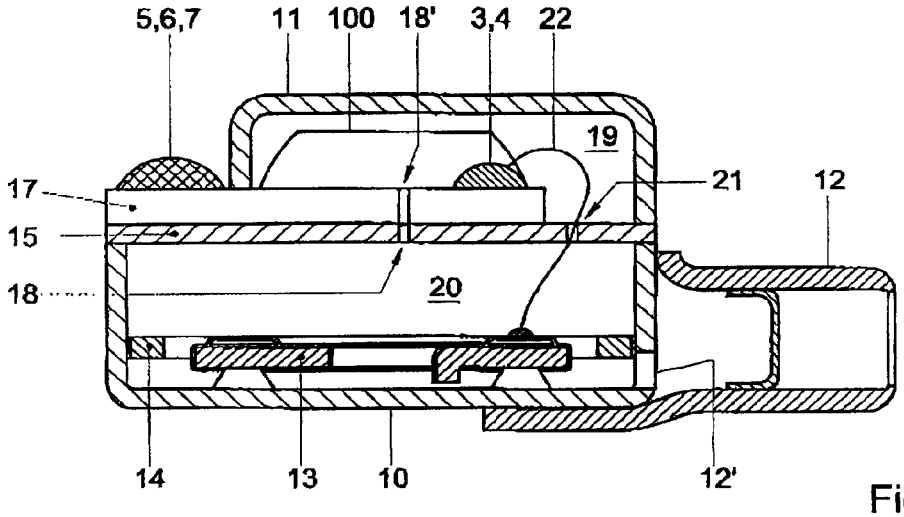
FIG. 1C is a schematic cross section of the microphone/amplifier system of FIG. 1A in assembled condition.
Figure 2:
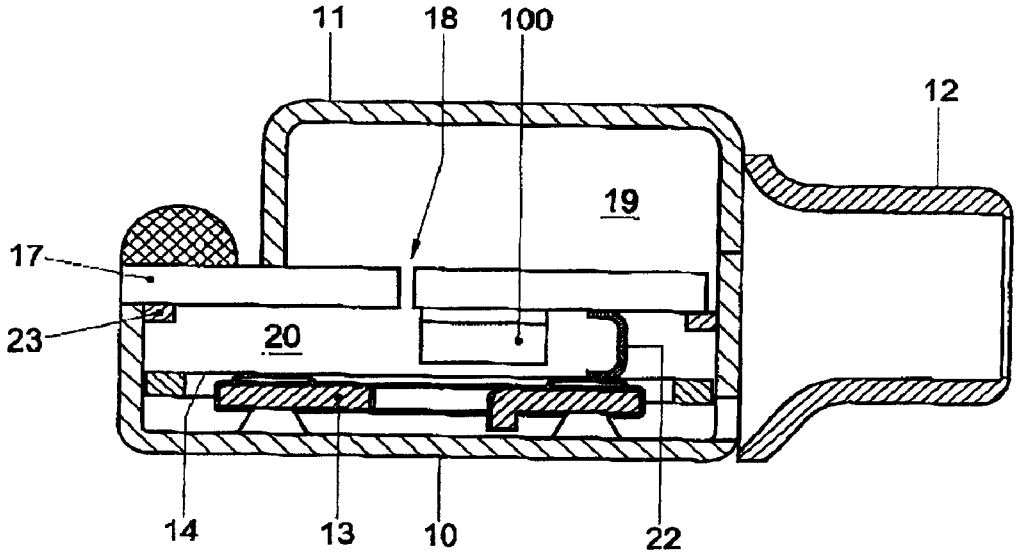
FIG. 2 is a cross section of a second embodiment of a microphone/amplifier system according to the invention.

Presently, referring to FIGS. 1 and 2, the structure and operation of an integrated microphone/amplifier unit 1 according to the invention will be clarified. The microphone/amplifier unit 1, also called microphone for short, comprises a boxlike case 10 and a cover 11, a sound inlet nozzle 12, a backplate 13 provided with a charged electret layer, a diaphragm 14, a mounting plate 15, and an amplifier module 100 on a carrier or printed circuit board 17 The combination of backplate 13 and diaphragm 14 is designated as microphone capsule 2. In assembled condition (FIG. 1C), the backplate 13 with the diaphragm 14 is mounted adjacent the bottom of the case 10, the mounting plate 15 is mounted on the case 10, and the printed circuit board 17 is mounted on the mounting plate 15. The cover 11 is placed over the printed circuit board 17, while leaving the electrical terminals 5, 6, 7 of the printed circuit board 17 clear. The mounting plate 15 forms the partition by which the case compartment which, viewed in the figure, is located above the diaphragm, is divided into two subcompartments 19 and 20. Sound can reach the interior of the case 10 via the sound inlet nozzle 12 and the passage 12' in the case wall, as a result of which the diaphragm 14 will start to move, so that the electret-microphone capsule 2 generates an electrical signal which is correlated to the pressure changes in the air in the space between the diaphragm and the bottom of the case. The electret-microphone capsule 2 is connected, through connecting wires 22 extending through a passage opening 21 in the mounting plate 15, with input terminals 3 and 4 of the amplifier module forming part of the unit 1, to supply the signal thereto. The electrical terminals 5, 6, 7 comprise two terminals 5, 7 for supplying electrical power to the amplifier module, and a signal output terminal 6 for providing an amplifier output signal, also designated as microphone signal.

Since the nature and construction of the unit 1, in particular the construction of the diaphragm 14 and the backplate 13, further do not constitute any subject matter of the present invention, and one skilled in the art does not require any knowledge thereof for a proper understanding of the present invention, they will not be further described here. For a more detailed description of the operation of an electroacoustic transducer of the electret type, and examples of possible constructions thereof, reference is made to the publication EP-A-0,533,284.

According to the invention, in the mounting plate 15 and in the printed circuit board of the amplifier module 100, openings 18 and 18', respectively, are provided, which have a diameter and length such that the air in the subcompartment 19 between the cover 11 and the mounting plate 15 is not caused to vibrate at higher audio frequencies, but is at lower frequencies. The location of the transitional frequency area in the total frequency spectrum is determined by the diameter and length of the openings 18 and 18', i.e., by the total volume of those openings.

The passage opening 21 in the mounting plate 15 for the connecting wire 22 is sealed with glue or the like, in order for this opening not to influence the frequency behavior.

FIG. 2 shows a second embodiment of the invention, in which parts equal to those in the embodiment according to FIG. 1 are indicated by the same reference numerals. The printed circuit board 17 is not mounted on the mounting plate 15 here, but is mounted on a supporting ring 23 in the case. The volume of the opening 18 in the printed circuit board 17 now influences the frequency characteristic of the microphone. The first subcompartment 19 is now located between the cover 11 and the top of the printed circuit board 17, while the second subcompartment 20 is the whole space between the underside of the printed circuit board 17 and the diaphragm.

In the embodiment of FIG. 2, the volume of the subcompartment 19 can be, for instance, approximately 6.5 $mm^3$ and that of the subcompartment 20 3.5 $mm^3$. The diameter of the opening 18 can be in the range of 0.05–0.1 mm. When the thickness of the printed circuit board 17 is, for instance, 0.3 mm, the opening 18 has a volume of 0.00058–0.0024 $mm^3$.

Figure 3A:
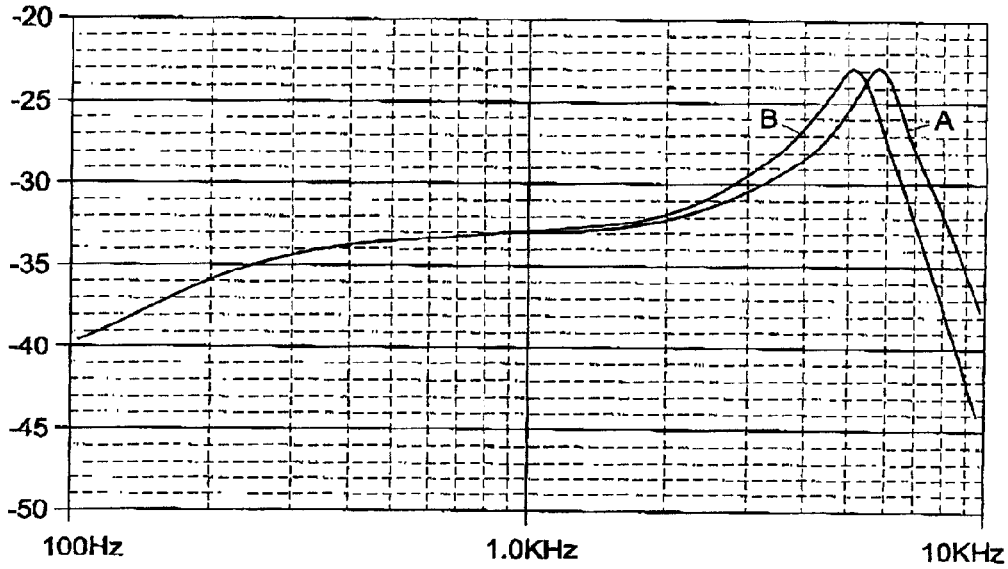
FIGS. 3A,B shows two frequency graphs of a conventional microphone/amplifier system and of a system according to the invention.

FIG. 3A shows a frequency graph in which curve A represents the frequency response of a first embodiment of a microphone/amplifier system and curve B represents the frequency response of a system according to the invention.

Figure 3B:
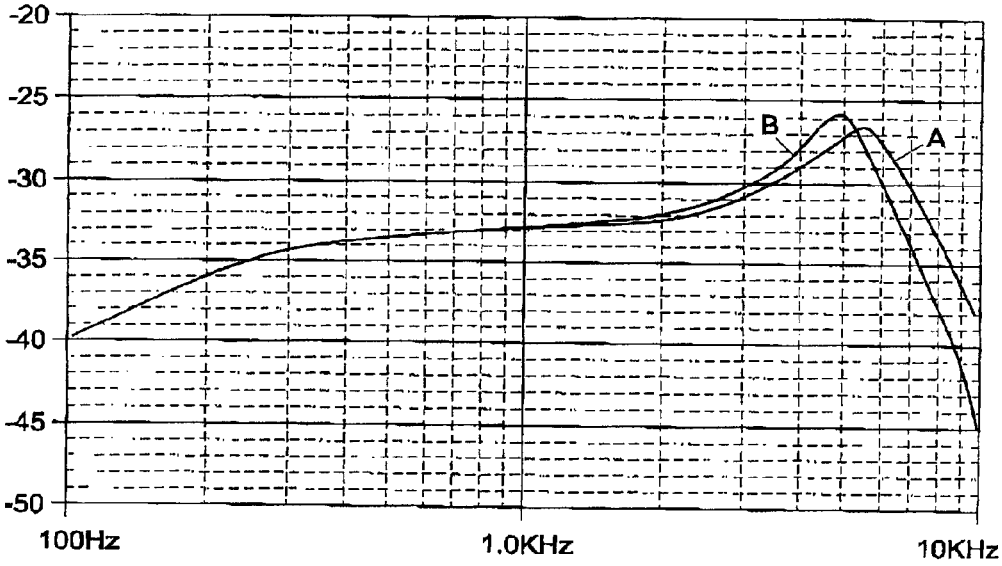

FIG. 3B shows similar graphs for a second embodiment of a microphone/amplifier system. As appears from the graphs, through the feature according to the invention, a shift of the peak in the frequency response by approximately 1 kHz is easy to realize.

The feature according to the present invention whereby an opening of a predetermined size is provided between a first and a second subcompartment in the second compartment, is easy and inexpensive to realize and can easily be incorporated in an automated production process. The opening in the second partition and/or printed circuit board can be provided by drilling, or by fitting a tube with a predetermined opening. Since the opening has a small diameter, his can be realized by first fitting a wire with a core and subsequently removing the core, the sheath of the wire forming the tube. The frequency response of the microphone can be accurately controlled by virtue of the invention, while in particular a lowering of the sensitivity of the microphone above a particular frequency has the advantage that it is thereby rendered more stable. Also, the resonance frequency can shift to a lower frequency, which is also advantageous in particular applications.

It will be clear to those skilled in the art that within the framework of the invention, variants of the embodiments shown are possible.

What is claimed is:

1. A system (1) consisting of a microphone and an amplifier, the microphone comprising a case (10, 11) having case walls, at least one opening to the surroundings being provided in at least one of the case walls, the microphone further comprising a system consisting of a diaphragm (14) and a backplate (13), the amplifier (100) being arranged in the case and being coupled to the system consisting of the diaphragm (14) and the backplate (13), the diaphragm (14) in the case (10, 11) forming a first partition between a first compartment in which the at least one opening to the surroundings terminates and a second compartment in which the amplifier is accommodated, the second compartment being essentially closed off from the surroundings, characterized in that the second compartment is divided into a first and a second subcompartment (19, 20) by a second partition (15, 17), an opening (18) of a predetermined volume being provided in the second partition (15, 17), the volume (18) having a magnitude such that air in the first subcompartment (19) can be caused to vibrate only with sound vibrations of low frequencies.

2. A system according to claim 1, characterized in that the first subcompartment is bounded by the second partition (15) and case walls (11), and the second subcompartment is bounded by the second partition (15), the diaphragm (14) and case walls (10), and that the amplifier (100) is accommodated in the first subcompartment (19).

3. A system according to claim 2, wherein the amplifier (100) is arranged on a printed circuit board (17), characterized in that the printed circuit board (17) rests on the second partition (15) and that a through-opening (18, 18') is provided in the printed circuit board and the second partition.

4. A system according to claim 1, characterized in that the amplifier (100) is arranged on a printed circuit board (17) extending parallel to the diaphragm (14), and that the printed circuit board constitutes the second partition.

5. A system according to claim 4, characterized in that the amplifier (100) is accommodated in the second subcompartment (20).

* * * * *